US008616012B2

(12) United States Patent
Duerr et al.

(10) Patent No.: US 8,616,012 B2
(45) Date of Patent: Dec. 31, 2013

(54) EVAPORATOR FOR A REFRIGERATION CIRCUIT

(75) Inventors: Gottfried Duerr, Stuttgart (DE); Guenther Feuerecker, Stuttgart (DE); Stefan Hirsch, Stuttgart (DE); Tobias Isermeyer, Loewenstein (DE); Caroline Schmid, Stuttgart (DE); Christoph Walter, Stuttgart (DE); Achim Wiebelt, Deidesheim (DE)

(73) Assignee: Behr GmbH & Co. KG, Stuttgart (DE)

( * ) Notice: Subject to any disclaimer, the term of this patent is extended or adjusted under 35 U.S.C. 154(b) by 230 days.

(21) Appl. No.: 13/156,002

(22) Filed: Jun. 8, 2011

(65) Prior Publication Data

US 2011/0296851 A1 Dec. 8, 2011

Related U.S. Application Data

(63) Continuation of application No. PCT/EP2009/065852, filed on Nov. 25, 2009.

(30) Foreign Application Priority Data

Dec. 8, 2008 (DE) ..... 10 2008 060 699

(51) Int. Cl.
*F25D 17/06* (2006.01)

(52) U.S. Cl.
USPC ..... 62/89; 62/515

(58) Field of Classification Search
USPC ..... 62/89, 225, 513, 515
See application file for complete search history.

(56) References Cited

U.S. PATENT DOCUMENTS

| | | | | |
|---|---|---|---|---|
| 5,609,036 | A | 3/1997 | Nagasawa et al. | |
| 5,836,383 | A * | 11/1998 | Zwittig | 165/167 |

FOREIGN PATENT DOCUMENTS

| | | | |
|---|---|---|---|
| DE | 195 28 116 | A1 | 2/1997 |
| DE | 10 2007 013 125 | A1 | 9/2008 |
| EP | 1118822 | A2 * | 7/2001 |
| EP | 1 832 822 | A2 | 9/2007 |
| EP | 1 835 251 | A1 | 9/2007 |
| EP | 1835251 | A1 * | 9/2007 |
| FR | 2 913 764 | | 9/2008 |
| FR | 2913764 | A1 * | 9/2008 |
| JP | 5-196321 | A | 8/1993 |
| JP | 05196321 | A * | 8/1993 |
| JP | 2004-12127 | A | 1/2004 |
| JP | 2008-215797 | | 9/2008 |

* cited by examiner

*Primary Examiner* — Mohammad M Ali
(74) *Attorney, Agent, or Firm* — Muncy, Geissler, Olds & Lowe, PLLC

(57) ABSTRACT

A vaporizer for a cooling circuit, particularly for a motor vehicle, is provided that includes a vaporization region, wherein a coolant flowing through the vaporization region takes up heat from an outside region, wherein the vaporization region is downstream of a first expansion element on the inlet side in the direction of flow of the coolant, wherein an exchanger member is provided between the vaporization region and the first expansion element, and wherein heat can be transferred from the coolant upstream of the vaporization region to the coolant downstream of the vaporization region.

20 Claims, 3 Drawing Sheets

EVAPORATOR FOR A REFRIGERATION CIRCUIT

This nonprovisional application is a continuation of International Application No. PCT/EP2009/065852, which was filed on Nov. 25, 2009, and which claims priority to German Patent Application No. DE 10 2008 060 699.5, which was filed in Germany on Dec. 8, 2008, and which are both herein incorporated by reference.

BACKGROUND OF THE INVENTION

1. Field of the Invention

The present invention relates to an evaporator for a refrigeration circuit, in particular for a motor vehicle and to an operating method for such an evaporator.

2. Description of the Background Art

It is known to regulate the flow of refrigerant through the evaporator of a refrigeration circuit, e.g. using a thermostatic expansion valve, in order to ensure overheating of the refrigerant on the outlet side of the evaporator or on the intake side of a compressor of the refrigeration circuit. As a result, the thermal capacity is not distributed homogeneously across the entire evaporator. This is undesired in general for evaporators used for air conditioning, and to a particular extent for cooling heat sources, in which case it is particularly important to remain within a preferred temperature range.

SUMMARY OF THE INVENTION

It is therefore an object of the invention to provide an evaporator for a refrigeration circuit, in the case of which a defined range having a particularly homogeneous thermal capacity is ensured.

The heat-exchanger element enables the refrigerant which emerges from the evaporator region to overheat in that heat is transferred in a defined manner from the inlet-side refrigerant flow to the emerging refrigerant flow. This makes it possible in particular for the refrigerant to flow through the evaporator region without overheating, or with only minimal overheating. The refrigerant can therefore also be present in the entire evaporator region as wet steam phase. A refrigerant in the sense of the invention is understood to be any suitable means for operating a refrigeration circuit, in particular in addition to conventional refrigerants such as R134a and $CO_2$. The first expansion device in the sense of the invention is understood to be any suitable expansion device, such as a fixed restriction, a thermostatic expansion valve (TXV), or even an electronically controlled expansion valve. Since the first expansion device is disposed upstream of the heat-exchanger element, the heat-exchanger element can also be considered to be an internal low-pressure heat exchanger of the refrigeration circuit. The evaporator according to the invention therefore comprises an evaporator region which exchanges heat mainly with the exterior region, and the heat-exchanger element which brings about mainly an internal heat exchange.

In an embodiment of the invention, a second expansion device is provided on the inlet side, between the heat-exchanger element and the evaporator region. As a result, the inlet-side portion of the heat-exchanger element disposed upstream of the evaporator region can transfer an amount of enthalpy to the outlet-side refrigerant flow in a particularly effective manner. To simplify the design, the second expansion element is preferably a fixed restriction, the size of which is selected accordingly. Depending on the requirements, the second expansion element can also be controllable, either alternatively or in addition to a controllable design of the first expansion element.

In an embodiment, the first expansion device is in the form of a single interface of evaporator region and heat-exchanger element with the remaining refrigerant circuit, wherein the first expansion device is in the form of a thermostatic expansion valve in particular.

In an embodiment, the first refrigerant undergoes substantially no overheating in the evaporator region during normal operation, although overheating does occur in the heat-exchanger element on the outlet side of the evaporator region. As a result, the entire evaporator region is subjected to substantially homogeneous thermal capacity and, in particular, there is no overheating region—the expansion of which is load-dependent—in the evaporator region.

The heat-exchanger element can be simply in the form of a section of parallel channels, wherein at least one inflow channel engages in thermal exchange with at least return channel via a partition. The number and length of the channels can be selected depending on the required capacity of the heat-exchanger element and the amount of installation space available. In a particularly preferred detailed embodiment, the inflow channel and the return channel extend substantially in the shape of a spiral. A compact heat-exchanger element can be obtained as a result. In the sense of the invention, a spiral shape is understood to be a circular, elliptical, or polygonal configuration, or any other spiral configuration.

In the interest of integrating components and minimizing installation space, it is provided in an embodiment that the evaporator region and the heat-exchanger element, at the least, are in the form of a structurally integrated unit. Depending on the requirements, the evaporator region and the heat-exchanger element can also be in the form of structurally separate units, however, which are not necessarily installed at different points, in particular, and are interconnected via refrigerant lines.

In an embodiment of the invention, the evaporator region is in the form of an air-conditioning evaporator—through which air flows—for conditioning an air flow, in particular in the form of a flat-tube evaporator.

In an embodiment of the invention, the evaporator is in the form of heat sink for cooling elements that are connected to the heat sink in a thermally conductive manner. In such evaporator regions, particularly high requirements are regularly placed on homogeneous cooling of all of the elements. One example of the spatial configuration of such an evaporator region is described in document EP 1 835 251 A1, which is incorporated herein by reference, and wherein the heat sink has a flat plate shape comprising holders for cylindrical storage cells disposed thereon in the manner of a hedgehog. The designs—according to the invention—of an evaporator region in the form of a heat sink are not limited to this example. For instance, the heat sink can also be designed to cool flat cells ("coffee bags") or prismatic cells, or can be designed as a folded heat sink or the like.

In an embodiment, the elements can be in the form of electrical energy accumulators, in particular lithium ion storage cells. Lithium ion storage cells require a high thermal capacity due to the high power density thereof, and make it necessary to place high requirements on adherence to a given temperature range to ensure functionality, operational reliability, and service life.

In an embodiment, an additional heat source, in particular power electronics, can be thermally connected to the heat-exchanger element. In such an embodiment, the heat-exchanger element is designed only partially as internal heat exchanger of the refrigeration circuit, and also permits heat to be exchanged with the exterior region, wherein the heat that is drawn in also ensures that the refrigerant in the heat-exchanger element will overheat. Alternatively, the heat-exchanger element can also be designed not to exchange heat with the exterior region, or can be designed as an exclusively internal heat exchanger.

According to a preferred, low-cost, and simple design, the heat sink has a plate-sandwich design in the evaporator region at least. Such a design of a plate-type evaporator is described, for example, in document DE 195 28 116 B4, which corresponds to U.S. Pat. No. 5,836,383, which is incorporated herein by reference, and in which case a plurality of layers of interrupted—and solder-plated in particular—plates are stacked one above the other in the manner of a sandwich to form channels for the refrigerant. The heat-exchanger element also can have a plate-sandwich design, in particular as a structural unit with the evaporator region.

The problem addressed by the invention is solved for an operating method of an evaporator. The regulation that is carried out to prevent overheating in the evaporator region ensures that cooling is particularly homogeneous.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
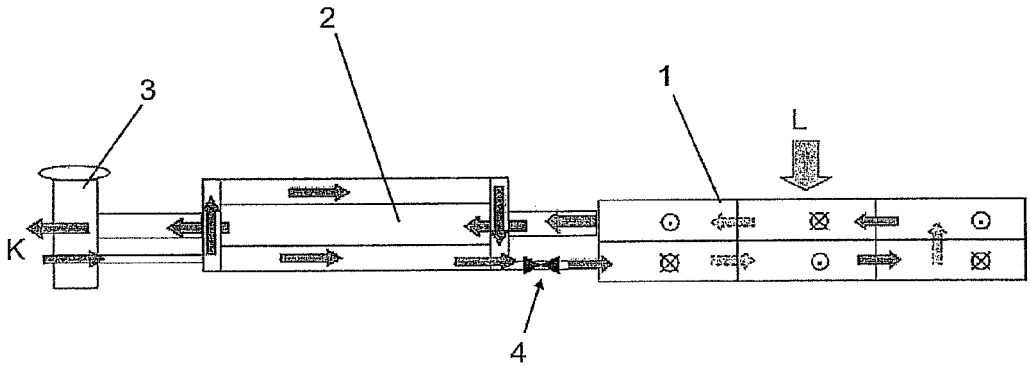
FIG. 1 shows a schematic depiction of a first embodiment of the invention.

The evaporator shown in FIG. 1 comprises an evaporator region 1 and a heat-exchanger element 2 attached thereto. Evaporator 1 is designed as a flat-tube evaporator for conditioning air L for a passenger compartment. To optimize the capacity thereof and improve homogeneity, it is divided into six blocks in the present case, through each of which a refrigerant K flows in succession. The evaporator region is therefore in the form of a heat exchanger that is thermally connected to the exterior region, wherein the heat-exchanger element is substantially in the form of an internal heat exchanger.

A thermostatic expansion valve 3, as a first expansion device, is disposed upstream of heat-exchanger element 2, wherein an inflowing stream of refrigerant is regulated by expansion valve 3. The stream of refrigerant emerging from the evaporator likewise flows through the expansion valve, and is regulated depending on the pressure and temperature of the emerging stream. Overheating of the emerging stream is continually ensured in this manner; the emerging stream subsequently enters a compressor of the refrigeration circuit on the intake side.

A second expansion device 4 in the form of a fixed restriction is provided on the inlet side of evaporator region 1, between heat-exchanger element 2 and evaporator region 1. As a result, the incoming flow of refrigerant is expanded only partially in the region of the heat-exchanger element, and a quantity of heat that suffices for overheating is transferred to the emerging flow in this region. When regulation is implemented accordingly, non-overheated refrigerant, i.e. wet steam, can be present in the entire evaporator region 1.

Figure 3:
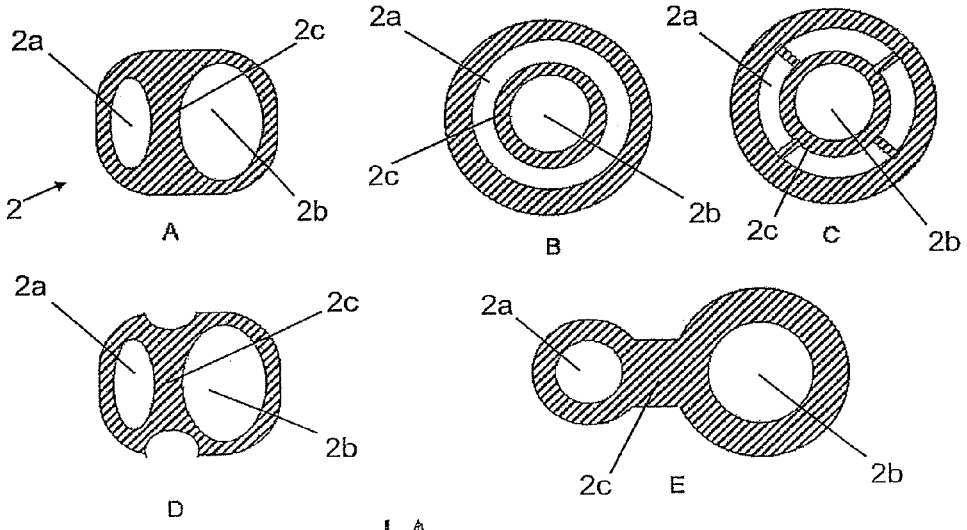
FIG. 3 shows a plurality of cross sections A-E of possible designs of a heat-exchanger element.

In a simple embodiment, the heat-exchanger element can be designed as parallel, inflow and return channels 2*a*, 2*b* having thermal contact via a wall 2*c*. FIG. 3 shows various suitable variants of such a configuration. Embodiments A, C, D, and E in particular can be in the form of extruded parts which comprise both channels 2*a*, 2*b*. Embodiment B is composed of two concentric tubes, on the ends of which supply pieces (not depicted) for the refrigerant are disposed. In any case, the hydraulic cross section for the return channel is greater than for the inflow channel, in order to account for the expansion in evaporator 1, 2.

Heat-exchanger element 2 can be designed e.g. as a multiple-channel tube section comprising flat-tube evaporator 3 as a structurally integrated unit. In particular, expansion valve 3 can also be provided on said unit. The connectors of expansion valve 3 form the only interface of evaporator 1, 2 with the remainder of the refrigerant circuit, in a known manner.

Figure 2:
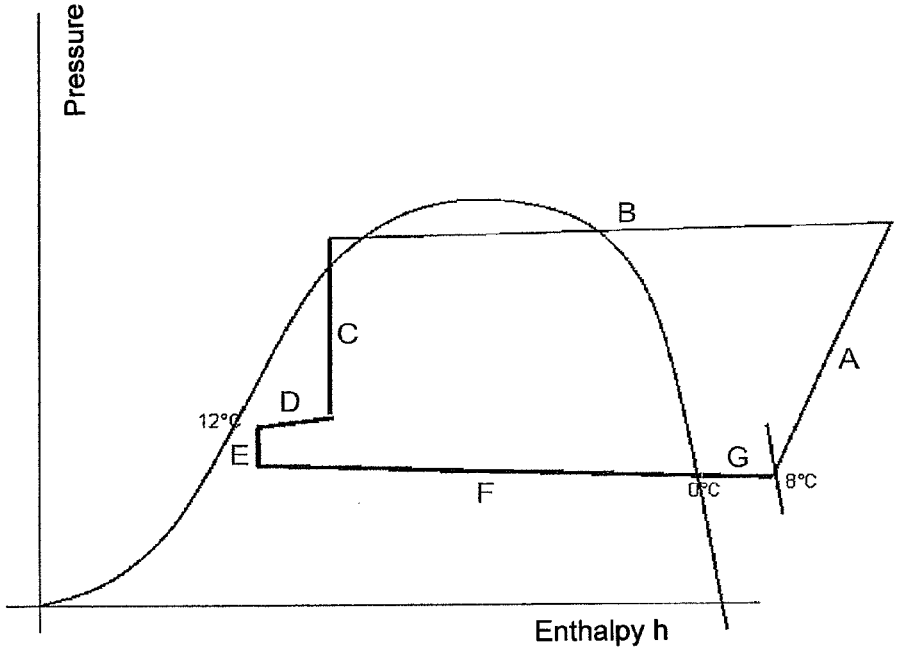
FIG. 2 shows a pressure-enthalpy diagram of a refrigeration circuit comprising an evaporator according to the invention.

In the circulation of the refrigerant represented in FIG. 2, the following take place in succession: compression A; approximately isobaric cooling in a condenser B; first isoenthalpic expansion C through expansion valve 3; approximately isobaric enthalpy release D in the inflowing portion of the heat-exchanger element; second approximately isobaric expansion E through fixed restrictor 4; approximately isobaric enthalpy absorption F in evaporator region 1; and overheating G in the out flowing portion of heat-exchanger element 2.

A state curve of the refrigerant is also shown in the state diagram, FIG. 2. Regions F and G abut one another at the intersection with the state curve. This represents the case in which overheating starts exactly at the transition from evaporator region 1 to heat-exchanger element 2.

Typical operating points for the refrigerant are, for example: 6 bar, 20° C. after first expansion device 3 or transition C to D, 6 bar, 10° C. after heat-exchanger element on the inlet side or transition D to E, 6 bar, 10° C. after heat-exchanger element 2 on the inlet side or transition D to E, 3 bar, 0° C. in evaporator region 1 or in region F up to the transition to G, 3 bar, 10° C. after heat-exchanger element 2 on the outlet side or transition G to A.

Figure 4:
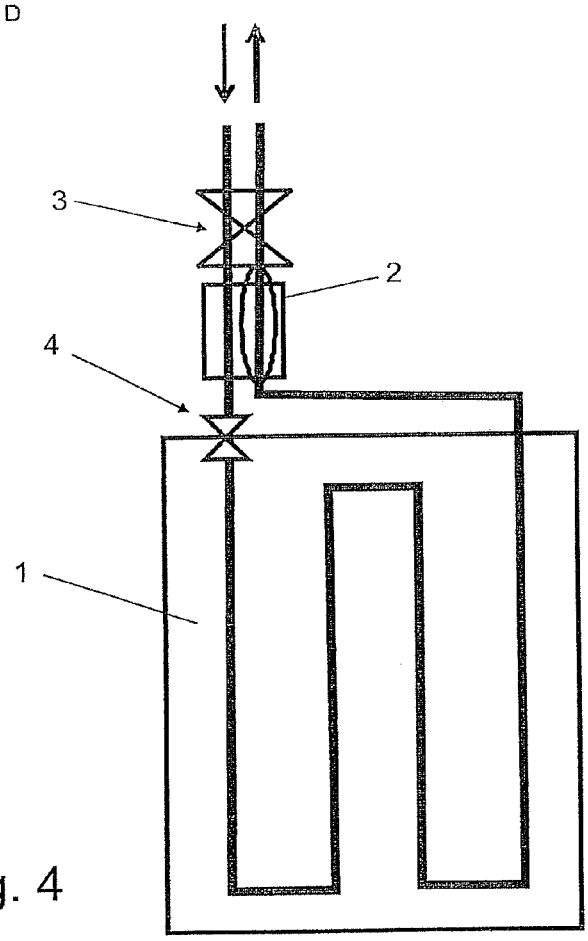
FIG. 4 shows a schematic depiction of a second embodiment of the invention.

The second embodiment, which is shown in FIG. 4, differs from the first example only in the structural design of evaporator region 1 in particular, although it is identical in terms of function (see FIG. 2).

In this particular case, evaporator region 1 is in the form of a plate-type heat sink on which elements to be cooled (which are not depicted), in the form of lithium ion storage cells, are attached in a thermally conductive manner. An example of a specific design of such an evaporator designed as a heat sink is described in document EP 1 835 251 A1.

In the structural detailed embodiment, the heat sink is in the form of a sandwich-plate design composed of solder-plated sheets or plates stacked on top of one another, wherein the refrigerant channels are formed in the plates using pre-punched openings. The plate stack is then soldered together in a flat manner in a soldering furnace. A detailed example of such a design of an evaporator is known from document DE 195 28 116 B4.

In the present example, heat-exchanger element 2 is provided separately from the plate-type heat sink or evaporator region 1, and is connected thereto via refrigerant lines.

Figure 5:
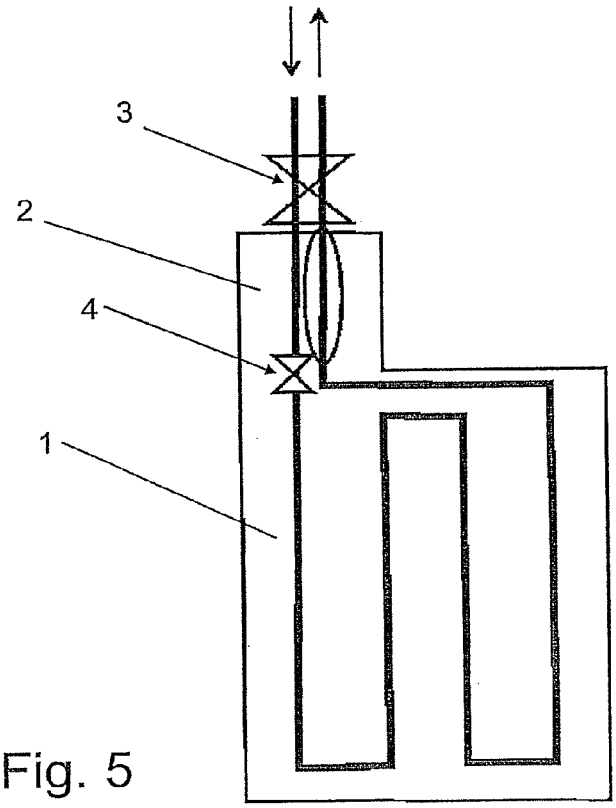
FIG. 5 shows a schematic depiction of a third embodiment of the invention.

In the third example, which is shown in FIG. 5, plate-type heat sink 1 is in the form of an integrated structural unit with heat-exchanger element 2, in contrast to the second embodiment.

Figure 6:
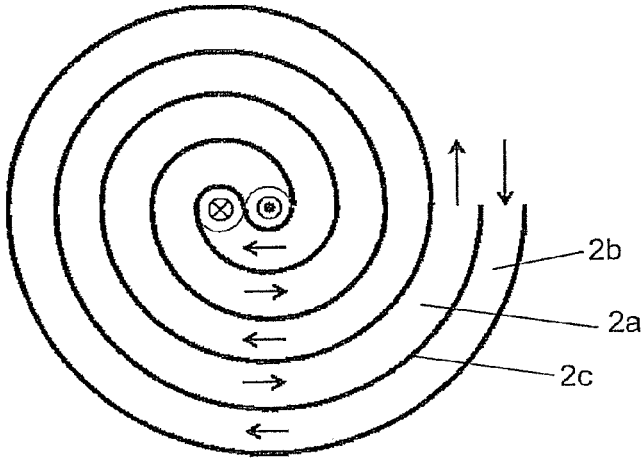
FIG. 6 shows a schematic depiction of a possible design of a heat-exchanger element.

FIG. 6 shows a shape of the refrigerant channels of heat-exchanger element 2 as an example, in which parallel inflow and return channels 2*a*, 2*b*, with thermally connecting partition 2*c* thereof, are wound as a spiral in a plane. In the center of the spiral, each of the channels is redirected downward, e.g. through a connecting hole in the cooling plate. The spiral shape of heat-exchanger element 2 compliments the property thereof as internal heat exchanger of the refrigeration circuit.

In the structural embodiment, spiral heat-exchanger element 2 is formed by a stack of interrupted plates, similar to evaporator region 1 shown in FIG. 4 and FIG. 5. In the example shown in FIG. 5, they are advantageously the same plates, continuously, as those of the evaporator region.

Alternatively, a spiral shape of the heat-exchanger element can also be attained by rolling up tubes which have cross sections such as those shown in FIG. 3, for instance.

Alternatively, the inflow and return channels depicted in the embodiments according to FIG. 3 and FIG. 6 can be interchanged, and so channels 2*a* are designed as return channels, and channels 2*b* are designed as inflow channels.

It is understood that the individual features of various embodiments can be combined with one another in a meaningful manner depending on the requirements.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An evaporator for a refrigerant circuit for a motor vehicle, comprising:

an evaporator region configured to have a refrigerant flow there through such that the evaporator region absorbs heat from an external region in the evaporator region, the evaporator region being disposed on an inlet side downstream of a first expansion device in a direction of the refrigerant flow; and a heat-exchanger element arranged between the evaporator region and the first expansion device, wherein heat from the refrigerant upstream of the evaporator region is transferable to the refrigerant downstream of the evaporator region, wherein an inflow of refrigerant into the heat-exchanger element and an outflow of refrigerant emerging from the heat-exchanger element pass through the first expansion device.

2. The evaporator according to claim 1, wherein a second expansion device is arranged on the inlet side, between the heat-exchanger element and the evaporator region.

3. The evaporator according to claim 1, wherein the first expansion device is the only interface of the evaporator region and the heat-exchanger element with the remainder of the refrigerant circuit, and wherein the first expansion device is a thermostatic expansion valve.

4. The evaporator according to claim 1, wherein the refrigerant undergoes no overheating in the evaporator region during normal operation, and wherein overheating occurs in the heat-exchanger element on an outlet side of the evaporator region.

5. The evaporator according to claim 1, wherein the heat-exchanger element comprises at least one inflow channel and at least one return channel that are parallel, and wherein the at least one inflow channel engages in thermal exchange with the at least one return channel via a partition.

6. The evaporator according to claim 5, wherein the inflow channel and the return channel extend in a shape of a spiral.

7. The evaporator according to claim 1, wherein the evaporator region and the heat-exchanger element are a structurally integrated unit.

8. The evaporator according to claim 1, wherein the evaporator region and the heat-exchanger element are structurally separated units.

9. The evaporator according to claim 1, wherein the evaporator region is an air-conditioning evaporator through which air flows for conditioning an air flow, the air-conditioning evaporator being in the form of a flat-tube evaporator.

10. The evaporator according to claim 1, wherein the evaporator is a heat sink for cooling elements that are connected to the heat sink in a thermally conductive manner.

11. The evaporator according to claim 1, wherein the evaporator is a heat sink for cooling electrical energy accumulators or lithium ion storage cells.

12. The evaporator according to claim 10, wherein a heat source is thermally connected to the heat-exchanger element.

13. The evaporator according to claim 10, wherein the heat sink has a plate-sandwich design in the evaporator region.

14. The evaporator according to claim 13, wherein the heat-exchanger element has a plate-sandwich design.

15. A method for operating the evaporator according to claim 1, the method comprising:

regulating the first expansion device, the regulation preventing the refrigerant from overheating at an outlet of the evaporator region; and ensuring overheating of the refrigerant at a subsequent outlet of the heat-exchanger element.

16. An evaporator, comprising:

a heat exchanger element;

a first expansion device disposed upstream of the heat exchanger element, wherein an inflow of refrigerant into the heat exchanger element and an outflow of refrigerant emerging from the heat exchanger element pass through the first expansion device;

an evaporator region configured to have the refrigerant flow there through, the evaporator region being disposed downstream from an inlet side of the first expansion device such that the heat exchanger element is disposed between the first expansion device and the evaporator region; and a second expansion device, comprising a fixed restriction, disposed between the heat exchanger element and the evaporator region, wherein the first expansion device is configured to regulate the inflow of refrigerant into the heat exchanger and to regulate the outflow of refrigerant from the heat exchanger.

17. The evaporator according to claim 16, wherein the evaporator region is divided into a plurality of blocks.

18. The evaporator according to claim 16, wherein the heat exchanger element comprises an inflow channel and a return channel parallel to the inflow channel.

19. The evaporator according to claim 16, wherein the first expansion device comprises a thermostatic expansion valve.

20. The evaporator according to claim 16, wherein the first expansion device is configured to regulate the outflow of refrigerant from the heat exchanger based on a pressure and a temperature of the outflow of refrigerant.

* * * * *